US006457793B1

(12) United States Patent
Su

(10) Patent No.: US 6,457,793 B1
(45) Date of Patent: Oct. 1, 2002

(54) SCREEN COLOR FOR DETECTING INK LEVEL FOR FOAM BASED INK SUPPLIES

(75) Inventor: Wen-Li Su, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/825,317

(22) Filed: Apr. 3, 2001

(51) Int. Cl.[7] ..... B41J 2/195
(52) U.S. Cl. ..... 347/7
(58) Field of Search ..... 347/7, 85–87

(56) References Cited

U.S. PATENT DOCUMENTS

| | | | | |
|---|---|---|---|---|
| 5,079,570 A | 1/1992 | Mohr et al. | ..... | 347/7 |
| 5,406,315 A | 4/1995 | Allen et al. | ..... | 347/7 |
| 5,555,238 A | 9/1996 | Miyazawa | ..... | 347/86 |
| 5,652,610 A | 7/1997 | Kawai et al. | ..... | 347/87 |
| 5,751,300 A | 5/1998 | Cowger et al. | ..... | 347/6 |

FOREIGN PATENT DOCUMENTS

| | | | | |
|---|---|---|---|---|
| JP | 10-100433 | 4/1998 | ..... | 347/7 |
| JP | 4101000433 A * | 4/1998 | ..... | 347/7 |

* cited by examiner

*Primary Examiner*—Craig Hallacher

(57) ABSTRACT

An inkjet printing system that includes an ink tank, an ink containing foam volume in the ink tank, and an ink level indicator having a wire mesh capillary element in contact with the ink containing foam volume and a fluid impermeable, light transmissive window in a wall of the ink tank adjacent the wire mesh.

14 Claims, 9 Drawing Sheets

SCREEN COLOR FOR DETECTING INK LEVEL FOR FOAM BASED INK SUPPLIES

BACKGROUND OF THE INVENTION

The disclosed invention relates to inkjet printing systems that employ replaceable consumable parts including ink cartridges, and more particularly to mechanisms for visibly indicating the amount of ink remaining in an ink cartridge.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or "pixels". Thus, the printing operation can be viewed as the filling of a pattern of dot locations with dots of ink.

Inkjet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

A printhead of a thermal inkjet printer is commonly implemented as an integrated circuit printhead that includes a nozzle plate having an array of ink ejecting nozzles, a plurality of ink firing chambers adjacent respective nozzles, and a plurality of heater resistors adjacent the firing chambers opposite the ink ejecting nozzles and spaced therefrom by the firing chambers. Each heater resistor causes an ink drop to be fired from its associated nozzle in response to an electrical pulse of sufficient energy. The printhead is mounted in a printhead cartridge that includes one or more ink reservoirs. Each of such ink reservoirs can comprise a replaceable main reservoir, a non-replaceable main reservoir, or an internal reservoir that receives ink from a remote or "off-axis" ink supply located remotely from the printhead cartridge.

A consideration with inkjet printing is the usefulness of knowing that an ink supply has reached a predetermined low level, which would allow appropriate action to be taken so that printing operations can be performed with minimal disruption, and without waste of time and ink that would result if the ink supply is depleted during a print job. Also, a printhead may be damaged if operated without adequate ink for ejecting.

Various mechanisms have been devised to sense the level of ink in inkjet reservoirs. Commonly assigned U.S. Pat. No. 5,751,300 (Cowger et al.) discloses an ink level sensor used in a trailing tube printer. A pair of electrical leads are implanted in a body of foam, and the current between the leads indicates ink level. The detected ink level is used to operate a valve that controls the amount of ink allowed into the print cartridge. Commonly assigned U.S. Pat. No. 5,079,570 (Mohr et al.) discloses a binary fluidic indicator in a disposable print cartridge that use a small tube or other element formed on the ink tank of an inkjet print cartridge. The main ink tank of the print cartridge is filled with a porous material such as polyurethane foam, glass beads, felt pen fibers, capillary tubes, and rolled up plastic film. The small element that provides the optical ink level indication holds free ink that is not suspended in a capillary material. When the ink level drops to a certain level, the capillary material in the main ink tank draws the ink from the indicator, to thus provide a binary indication that the ink has dropped to a selected level. The indicator can be either human or machine readable. Commonly assigned U.S. Pat. No. 5,406,315 (Allen et al.) discloses an optical sensor that detects the temperature and ink level based on changes in the reflectivity of a phase change material adjacent to or within the pen body housing.

Despite the foregoing and other ink level detection and indicating mechanisms, there remains a need for an inexpensive and reliable system for indicating and/or detecting the level of ink in inkjet ink supplies.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
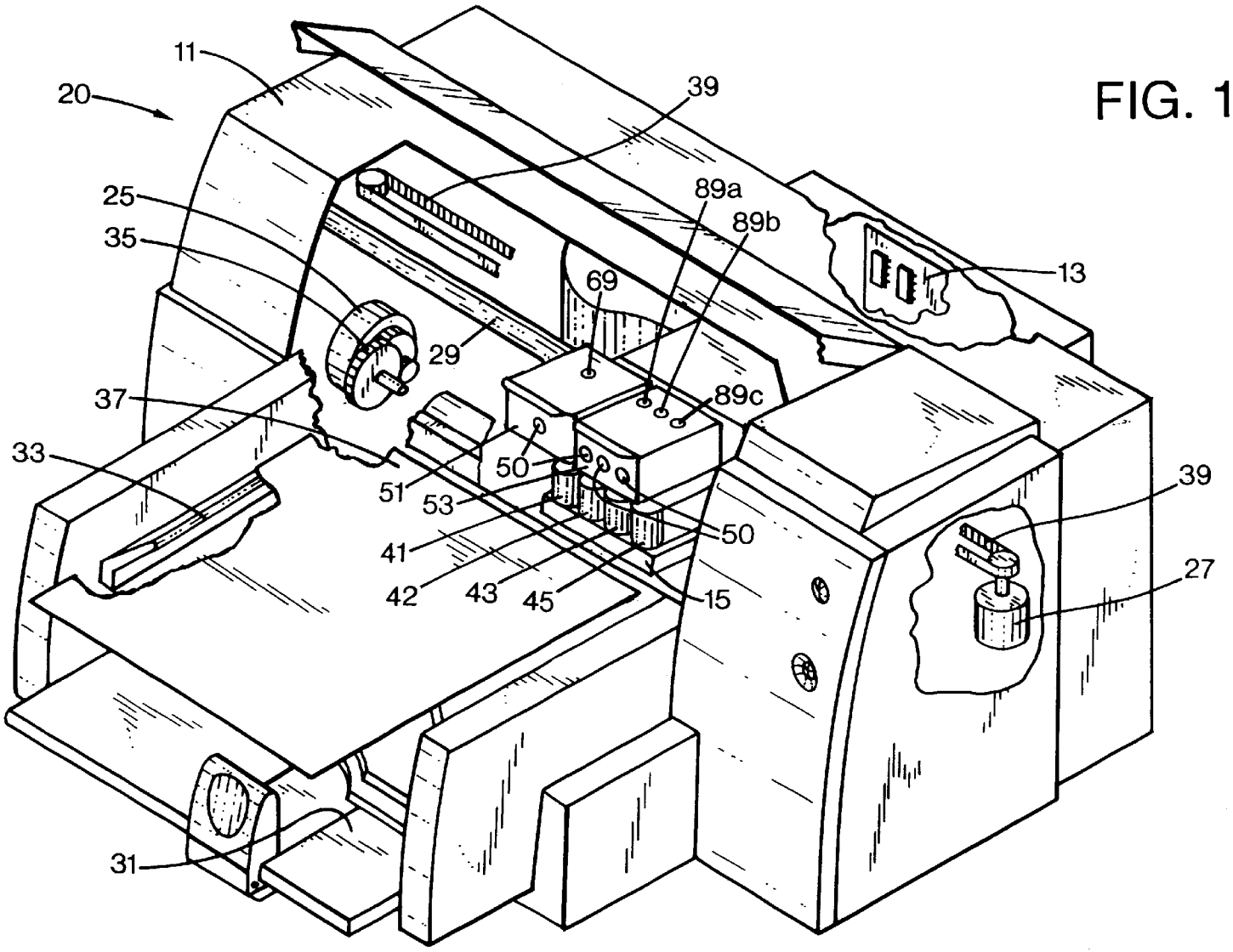
FIG. 1 is a partially fragmented schematic perspective view of an inkjet printing mechanism that employs ink level indication in accordance with the invention.

In the following detailed description and in the several figures of the drawing, like elements are identified with like reference numerals.

Referring now to FIG. 1, set forth therein is a schematic partially fragmented perspective view depicting, by way of illustrative example, major mechanical components of a swath type inkjet printer 20 employing ink level indication in accordance with the invention.

The printer 20 includes a housing 11 in which are mounted a controller 13, a print carriage 15 that supports a plurality of inkjet printheads, a print medium advance motor 25, and a carriage drive motor 27. The print carriage 15 is slidably supported by print carriage slider rod 29 having a longitudinal axis parallel to a carriage scan axis Y.

Also attached to the housing 11 are a paper input tray 31 for holding a stack of print medium sheets, and retractable output sheet supporting wings 33. The controller 13 is electrically connected to a host computer device (not shown), such as a personal computer, from which it receives data signals representative of the image and/or text desired to be printed. The controller 13 is also electrically connected with the printheads supported by the print carriage 15, the print medium advance motor 25, and the carriage drive motor 27.

The medium advance motor 25 is coupled via a gearing assembly 35 to polymeric rollers (not shown) that drive a sheet of print medium 37 through the printer. The medium advance motor 25 is further selectively engaged via clutch and gearing assembly (not shown) to the output sheet supporting wings 33 to selectively extend and retract the wings 33 pursuant to commands from the controller 13. The carriage drive motor 27 is linked via a drive belt 39 to the print carriage 15, and causes the print carriage 15 to reciprocatingly translate or scan on the slider rod 29 along the carriage scan axis Y pursuant to pursuant to commands from the controller 13.

At an appropriate time, the controller 13 actuates the carriage drive motor 27 to drive the print carriage 15 along the carriage scan axis to scan the supported printheads over a current swath on the sheet 37. As the print carriage 15 is scanned along the carriage scan axis, the printheads are addressed by the controller 13 to expel droplets of ink in the desired dot matrix pattern across the sheet 37. After a scan of the print carriage 15 is complete, the controller 13 commands the medium advance motor 25 to advance the sheet 37 incrementally along a media advance axis X shown so that the printheads can perform another pass. Successive scans of the print carriage 15 along the carriage scan axis Y are made to complete the printing of the desired image on the sheet of print medium 37. More than one pass or scan can made over the same section of the sheet of print medium without advancing the sheet. As the sheet of print medium 37 is printed and advanced, it is supported by the wings 33. After printing of the sheet 37 is completed, and when an immediately previously printed sheet is dry and/or when a new sheet is ready to be printed, the wings 33 retract to the sides and allow the sheet 37 to drop vertically down onto any immediately previously printed sheet of print medium.

Figure 2:
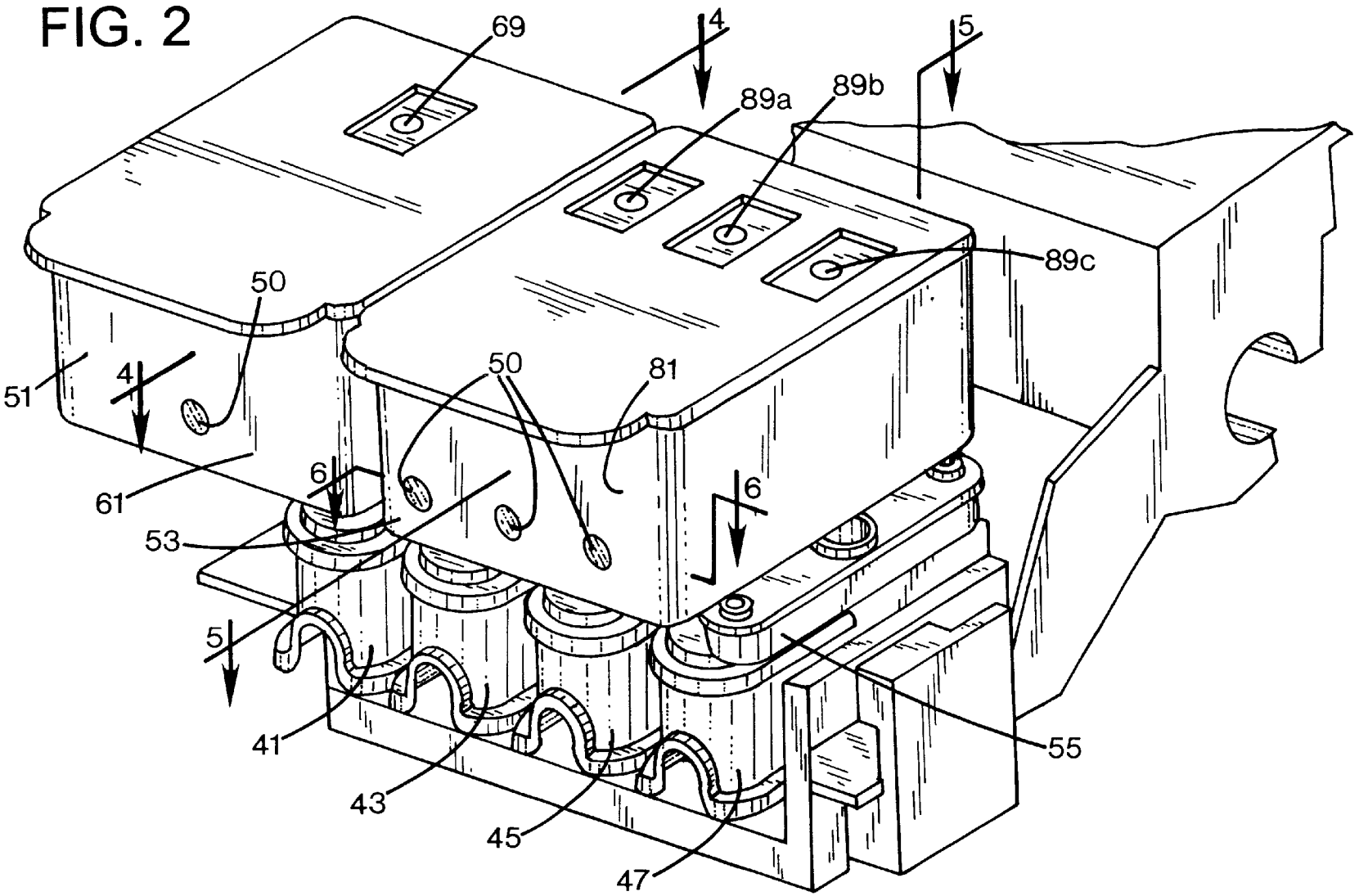
FIG. 2 is a schematic perspective view of an inkjet print carriage that can be used as the print carriage of the printer of FIG. 1.
Figure 3:
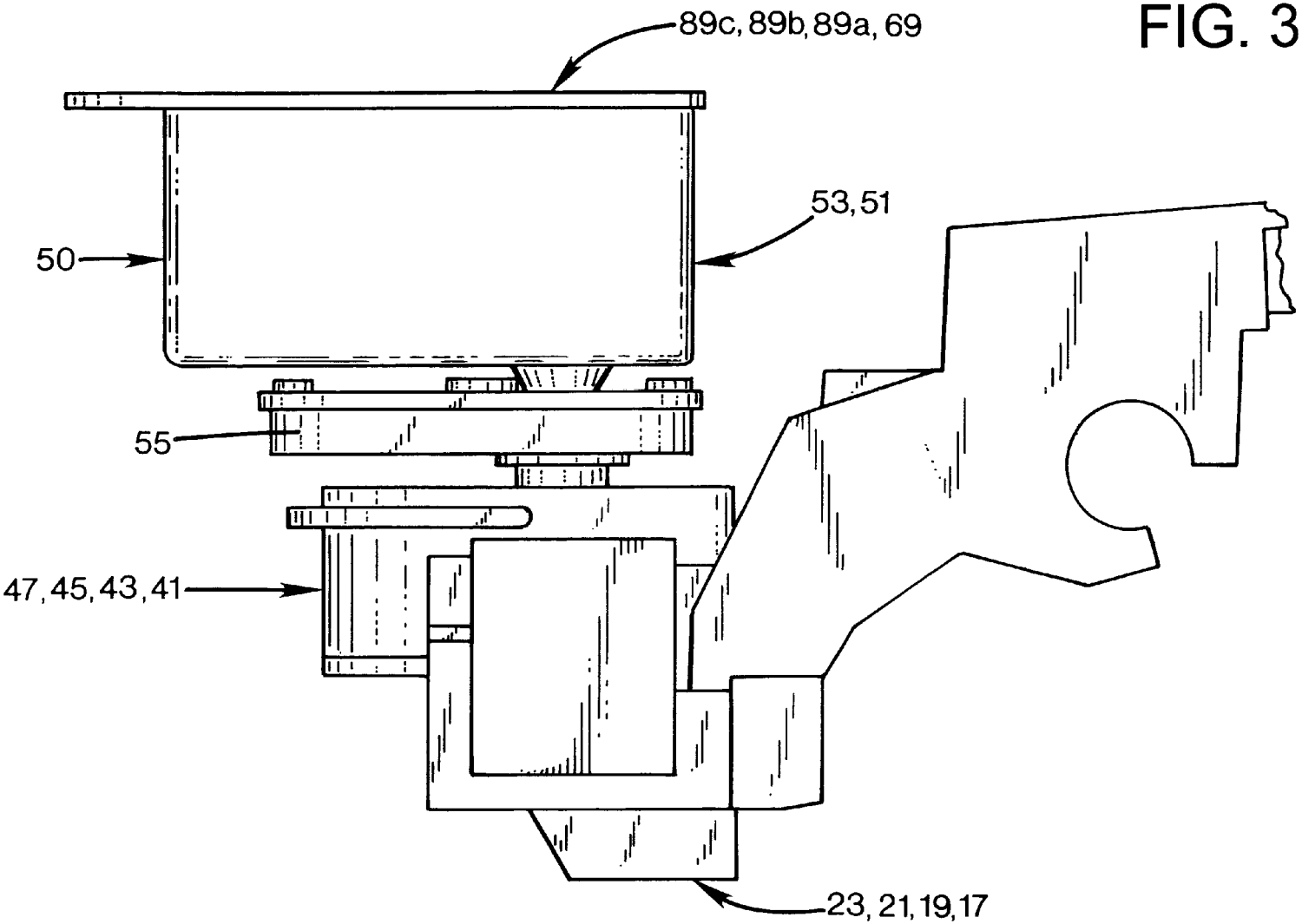
FIG. 3 is a schematic side elevational view of the inkjet print carriage of FIG. 2.

Referring now to FIGS. 2 and 3, schematically illustrated therein is an inkjet print carriage in accordance with the invention that can be used as the print carriage 15 of the printer of FIG. 1. The inkjet print carriage includes a plurality of inkjet print cartridges 41, 43, 45, 47 respectively having inkjet printheads 17, 19, 21, 23. A replaceable single chamber ink tank 51 and a replaceable tri-compartment ink tank 53 are removably mounted on a manifold assembly 55 that fluidically couples the ink tanks 51, 53 to the print cartridges 41, 43, 45, 47. In particular, the single chamber ink tank 51 is fluidically coupled to the print cartridge 41, and the three compartments of the tri-compartment ink tank 53 are respectively fluidically coupled to the print cartridges 43, 45, 47.

Figure 4:
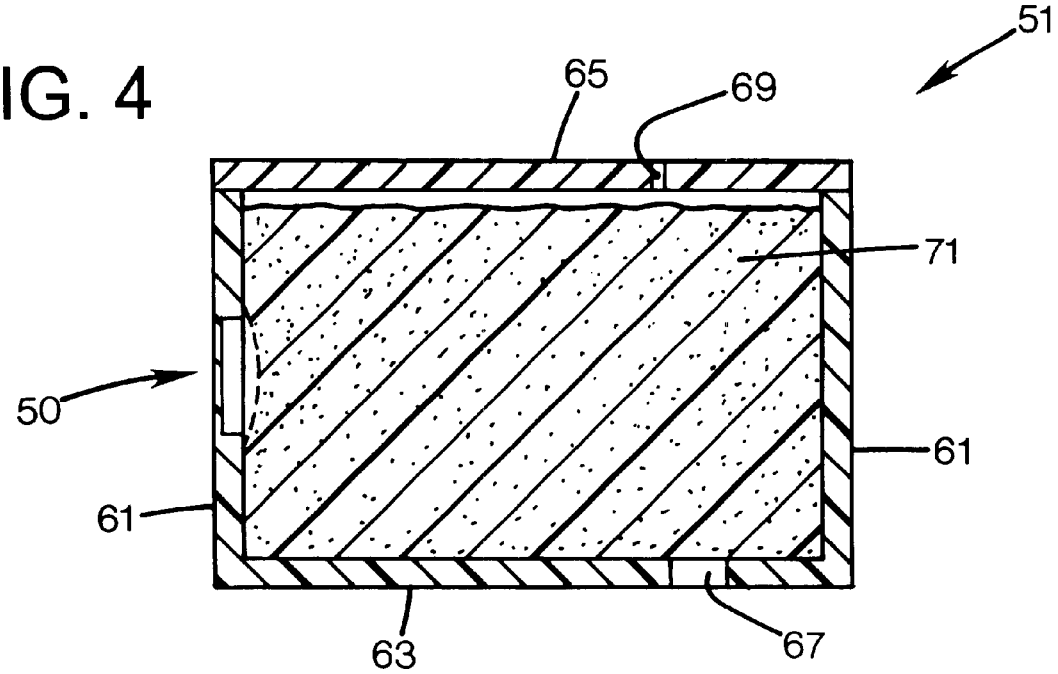
FIG. 4 is a schematic cross-sectional elevational view of a single compartment ink tank of the print carriage of FIG. 2.

Referring now to FIG. 4, the single compartment ink tank 51 comprises a housing having side walls 61, a bottom wall 63 and a top wall 65. An ink port 67 disposed in the bottom wall 63 of the ink tank housing is configured to be fluidically coupled to the manifold assembly 55 (FIG. 2). The top wall 65 includes an air vent 69.

A volume of ink retaining foam or other capillary material 71 is disposed in the interior of the housing of the ink tank 51. Ink is infused into the foam 71 which retains ink at a pressure that is less than atmospheric or ambient pressure. By way of illustrative example, the volume of foam 71 comprises reticulated polyurethane foam. Alternatively, a volume of glass beads, or a volume of foam and a volume of glass beads can be utilized as an ink retaining capillary volume.

Figure 5:
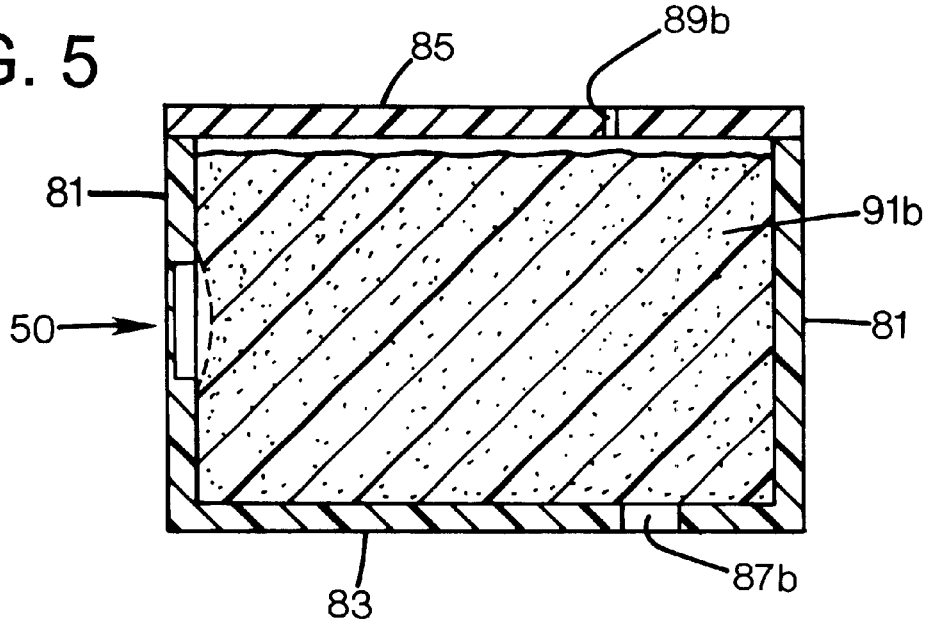
FIG. 5 is a schematic cross-sectional elevational view of a tri-compartment ink tank of the print carriage of FIG. 2.
Figure 6:
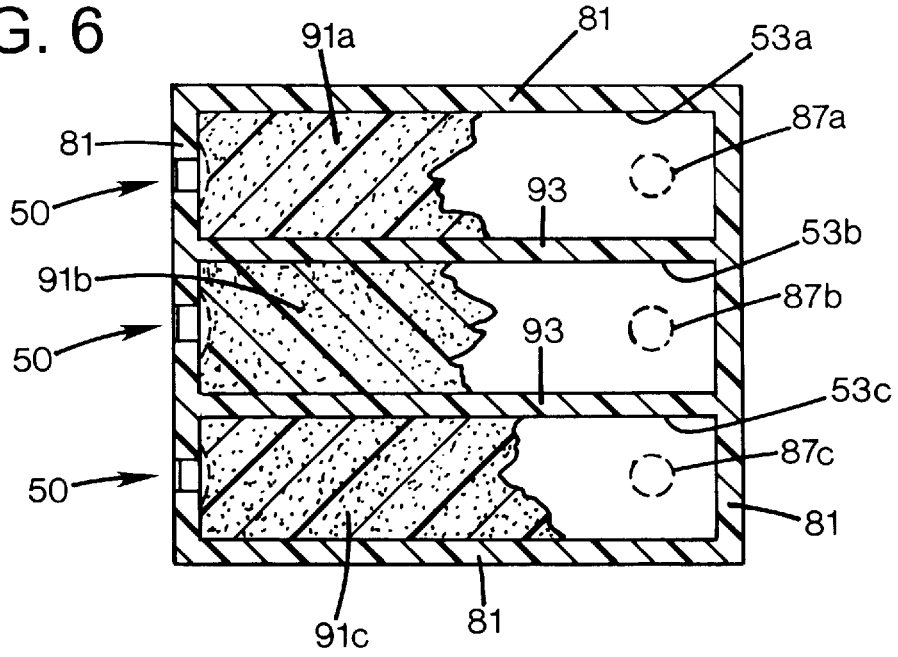
FIG. 6 is a schematic cross-sectional plan view of the tri-compartment ink tank of the print carriage of FIG. 2.

Referring now to FIGS. 5 and 6, the tri-compartment ink tank 53 comprises a housing having external side walls 81, a bottom wall 83 and a top wall 85. Internal walls 93 divide the interior of the ink tank 53 into three tank compartments 53*a*, 53*b*, 53*c*. Ink ports 87*a*, 87*b*, 87*c* disposed in the bottom wall 83 of the ink tank housing and respectively in fluidic communication with the compartments 53*a*, 53*b*, 53*c* are configured to be fluidically coupled to the manifold assembly 55 (FIGS. 2 and 3). The top wall 85 includes air vents 89*a*, 89*b*, 89*c* (FIGS. 2 and 3.).

Volumes of ink retaining foam 91*a*, 91*b*, 91*c* are respectively disposed in the respective tank compartments 53*a*, 53*b*, 53*c*. Ink is infused into the volumes of foam which retain ink at a pressure that is less than ambient or atmospheric pressure. By way of illustrative example, each of the volumes of comprises reticulated polyurethane foam. Alternatively, a volume of glass beads, or a volume of foam and a volume of glass beads can be utilized as an ink retain volume.

In accordance with the invention, respective visually or electro-optically detectable ink level indicators 50 are provided for each of the compartments of the ink tanks 51, 53, for example in one of the housing side walls that is oriented vertically when the ink print cartridge is installed in the printer and is visible when the ink tank is installed in a printer.

Figure 7:
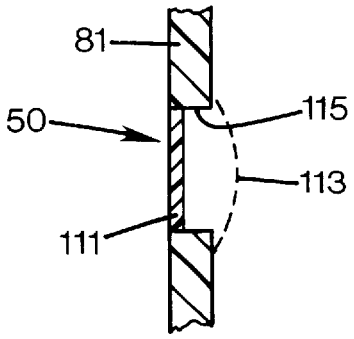
FIG. 7 is a schematic illustration of an ink level indicator in accordance with the invention.

Referring now to FIG. 7, schematically illustrated therein is a representative ink level indicator 50 as implemented in a side wall 81 of the ink tank 53 (FIG. 2) for the ink tank compartment 53*b* (FIGS. 5 and 6). The ink level indicator includes a fluid impermeable, light transmissive window 111 located in the side wall 81 of the tank housing and a thin capillary element 113 located in the associated compartment 53*b* in contact with the foam volume 91*b* (FIG. 6) contained in the compartment 53*b*. The thin capillary element 113 is separated from the fluid impermeable, light transmissive window 111 by a closed wall 115 formed for example by a portion of the thickness of the side wall of the tank housing. The pressure in the foam is less than ambient due to the capillarity of the foam; and the fluid impermeable, light transmissive window 111, the thin capillary element 113, and the closed wall 115 are particularly configured to form an enclosed ink level indicating chamber or region that is fluidically sealed when the foam adjacent the thin capillary element contains sufficient ink to prevent ambient pressure from being communicated to the ink level indicating chamber, and has a pressure that is appropriately less than and close to the pressure in the adjacent foam when sealed from ambient pressure by the adjacent ink containing foam. In particular, when the ink tank is assembled and filled with ink, the pressure in the ink level indicating chamber is controlled such that when the ink level indicating chamber is sealed from ambient pressure by adjacent ink containing foam and the tank is ready for use, the pressure in the ink level indicating chamber is less than and close to the pressure in the adjacent ink containing foam, and thus less than ambient.

By way of illustrative example, as shown in FIG. 7, the fluid impermeable, light transmissive window 111 is disposed at an outer side of an opening in a side wall 81 of the tank and is thinner than the side wall, while the thin capillary element 113 is disposed over the inner side of the opening in the side wall of the tank. In other words a transparent, windowed cavity is formed on the inside of a side wall of the tank, and a thin capillary element extends over such cavity on the inside of the tank. The fluid impermeable, light transmissive window can be integrally formed or molded with the supporting side wall, or it can be bonded into an opening in the supporting side wall. The thin capillary element 113 is suitably bonded to the inside of the supporting side wall, and for example is concave into the interior of the ink tank, so as to enhance contact with the capillary volume inside the tank. The thin capillary element 113 can also be planar as shown in FIG. 9.

Figure 8:
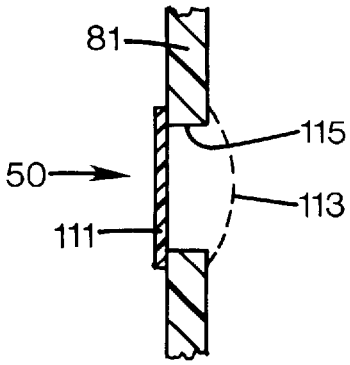
FIG. 8 is a schematic illustration of a further ink level indicator in accordance with the invention.

Alternatively, as shown in FIG. 8, the fluid impermeable, light transmissive window 111 comprises fluid impermeable, light transmissive tape or film applied over the opening in the side wall 81.

Figure 9:
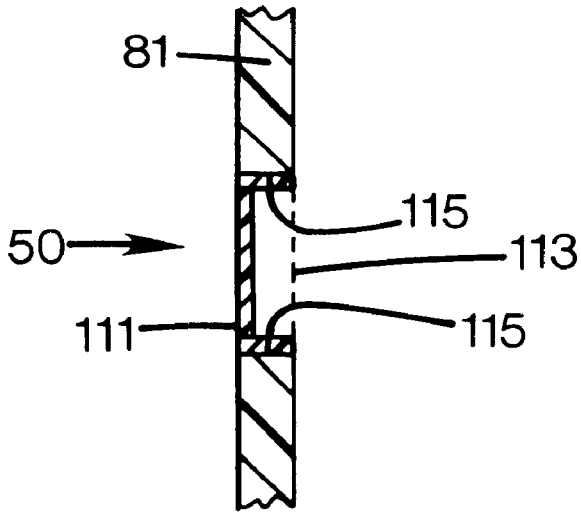
FIG. 9 is a schematic illustration of another ink level indicator in accordance with the invention.

As a further alternative, as shown in FIG. 9, the thin fluid impermeable, light transmissive window 111, the closed wall 115, and the thin capillary element 113 can comprise a separate assembly that is bonded in an opening in a side wall of the ink tank.

Each of the ink tanks 51, 53 is for example filled with ink under conditions of vacuum such that when the vacuum is removed the pressure in each of the ink level indicating chambers is less than and close to the pressure of the adjacent ink containing foam. Alternatively, if the fluid impermeable, light transparent window is resilient, it can be deformed inwardly while the foam volume is filled with ink, and then released.

So long as there is sufficient ink in the foam to prevent ambient pressure from being communicated to the ink level indicating chamber, air cannot enter the ink level indicating chamber and the pressure within the ink level indicating chamber remains less than and close to the pressure in the foam in contact with the thin capillary element. In such condition, ink suspended in the thin capillary element bulges toward the fluid impermeable, light transmissive window since the pressure in the ink level indicating chamber is less than the pressure in the adjacent foam, and the thin capillary element surface facing the window takes on the color of the ink suspended therein.

When ink is sufficiently depleted from the foam volume to provide an air path to the ink level indicating chamber, ambient air pressure pushes ink from openings in the thin capillary element and air enters the ink level indicating chamber, whereby the pressure in the ink level indicating chamber increases to ambient which is greater than the pressure in the foam volume in contact with the thin capillary element. In such condition, ink suspended in the thin capillary element is drawn toward the foam volume since the pressure in the foam is less than the pressure in the ink level indicating chamber, and the thin capillary element 113 takes on the color of the material of which it is made. Thus, when the thin capillary element does not have the color of the ink in the ink tank, the level of ink in the ink tank is below the top of the thin capillary element.

Effectively, the color taken on by the thin capillary element surface facing the fluid impermeable, light transmissive window is controlled by the pressure in the region between the thin capillary element and the fluid impermeable, light transmissive window relative to the pressure in the foam adjacent the thin capillary element. When the region is sealed from ambient pressure by sufficient ink in the adjacent foam and the pressure in such region is less than the pressure in the adjacent foam (which is less than ambient), ink suspended in the thin capillary element bulges into the interior of the ink level indicating chamber, whereby the thin capillary element surface facing the fluid impermeable, light transmissive window takes on the color of the ink suspended therein. When the pressure in such region is at ambient pressure and thus greater than the pressure in the adjacent foam, ink suspended in the thin capillary element is drawn towards the adjacent foam and the thin capillary element surface facing the fluid impermeable, light transmissive window takes on the color of the material from which it is made.

In accordance with a specific aspect of the invention, the thin capillary element comprises a filament mesh, such as a stainless steel wire mesh. The thin capillary element can also comprise cloth. The pore size of the thin capillary element is selected so that the pressure difference between the ink containing foam and the ink level indicating chamber as sealed by the ink containing foam can only draw ink suspended in the pores to one side of the thin capillary element. In other words, ink should not be released into the ink level indicating chamber. Factors that would affect the selection of the pore size would include the surface wettability characteristics of the thin capillary element, the surface energy and viscosity of the ink, and the likely pressure difference between the pressure in the ink level indicating chamber and the adjacent ink containing foam. Effectively, ink suspended in the thin capillary element should not be drawn out of the thin capillary element into the ink level indicating chamber when the ink level indicating chamber is sealed by ink containing foam adjacent the thin capillary element.

Figure 10:
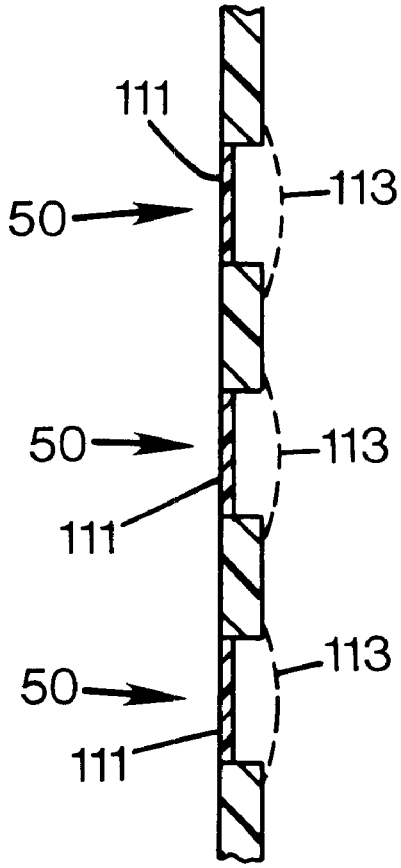
FIG. 10 is a schematic illustration of an implementation of the invention that employs a plurality of ink level indicators.

Referring now to FIG. 10, schematically illustrated therein is a further implementation of the invention which includes a plurality of ink level indicators 50 arranged vertically in a side wall of an ink tank. In this implementation, the ink level indicators provide an indication of decreasing levels of empty.

Figure 11:
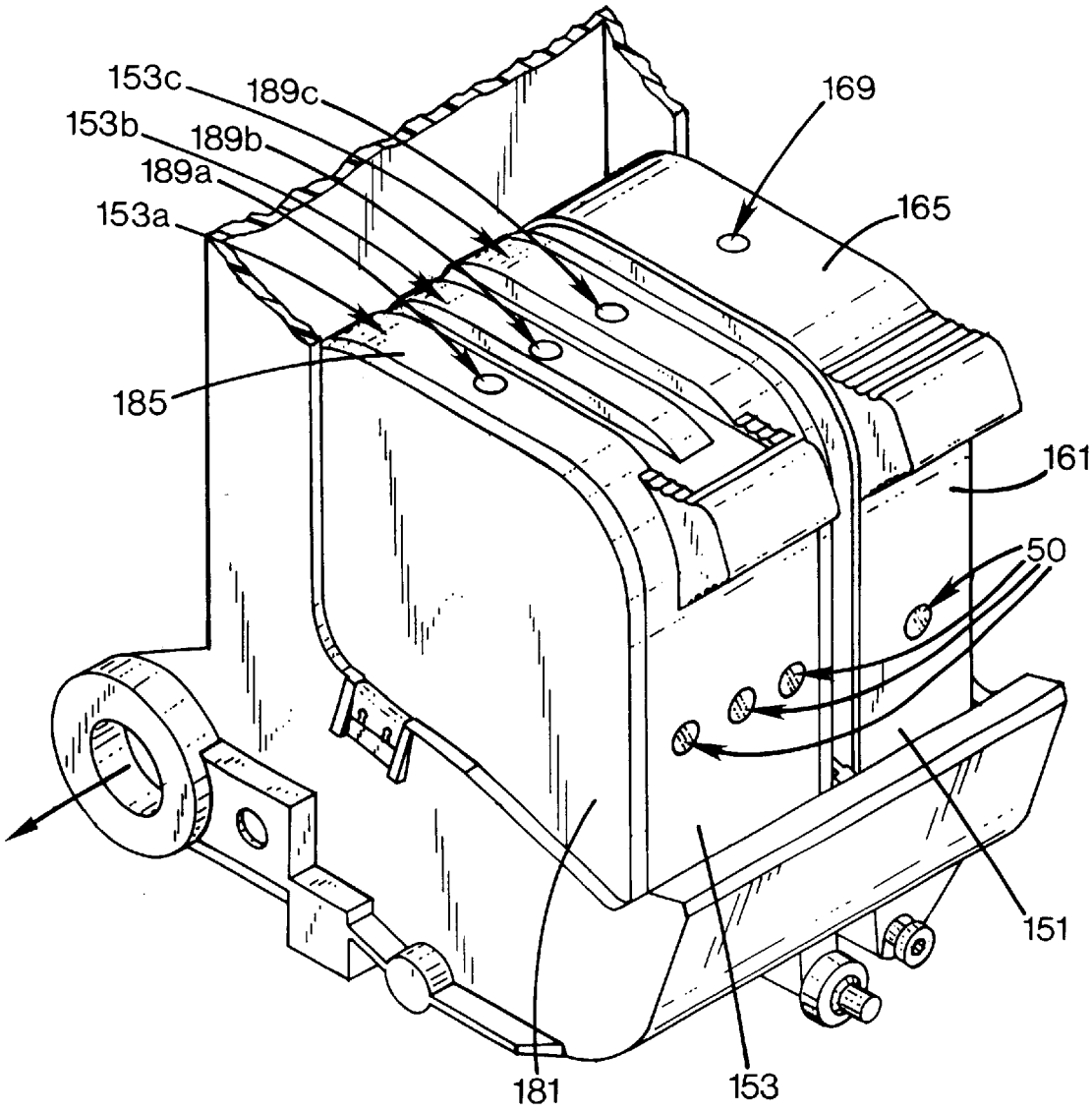
FIG. 11 is a schematic perspective illustration of another print carriage that can be employed in the printer of FIG. 1.
Figure 12:
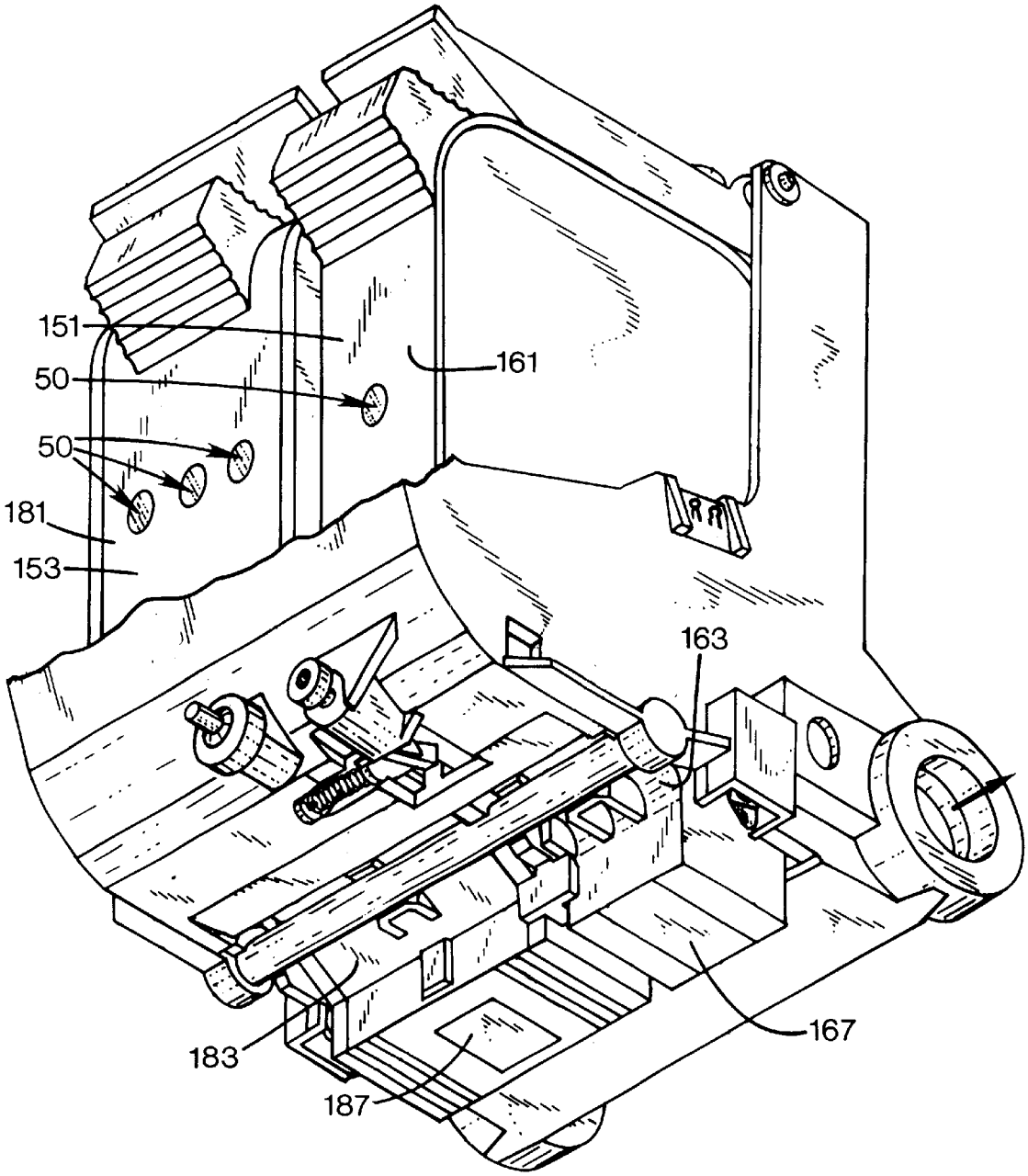
FIG. 12 is a further schematic illustration of the print carriage of FIG. 11.

Referring now to FIGS. 11 and 12, schematically illustrated therein is an inkjet print carriage that can be used as the print carriage 15 of the printer of FIG. 1. The inkjet print carriage of FIGS. 11 and 12 includes a single chamber print cartridge 151 and a tri-compartment print cartridge 153 that include ink level indicators 50 in accordance with the invention.

The single chamber print cartridge 151 includes a cartridge housing having side walls 161, a bottom wall 163, a top wall 165 and a printhead 167. The top wall 165 includes an air vent 169. A volume of ink retaining foam is disposed in the interior of the cartridge housing, similarly to the ink tank 51 of FIGS. 2 and 4, and the ink level indicator 50 is disposed in a side wall 161 that is configured to be vertical when the print cartridge is installed in a printer.

The tri-compartment print cartridge 153 includes a cartridge housing having side walls 181, a bottom wall 183, a top wall 185 and a printhead 187. Internal walls divide the interior of the housing into three ink compartments 153*a*, 153*b*, 153*c*, and the top wall 185 includes respective air vents 189*a*, 189*b*, 189*c* for such compartments. Respective volumes of ink retaining foam are disposed in respective ink compartments 153*a*, 153*b*, 153*c*, similarly to the ink tank 53 of FIGS. 2, 5 and 6, and respective visually or electro-optically detectable ink level indicators 50 are provided for each of the compartments 153*a*, 153*b*, 153*c*, for example in a housing side wall 181 that is oriented vertically when the ink print cartridge is installed in the printer and is visible when the ink tank is installed in a printer.

Figure 13:
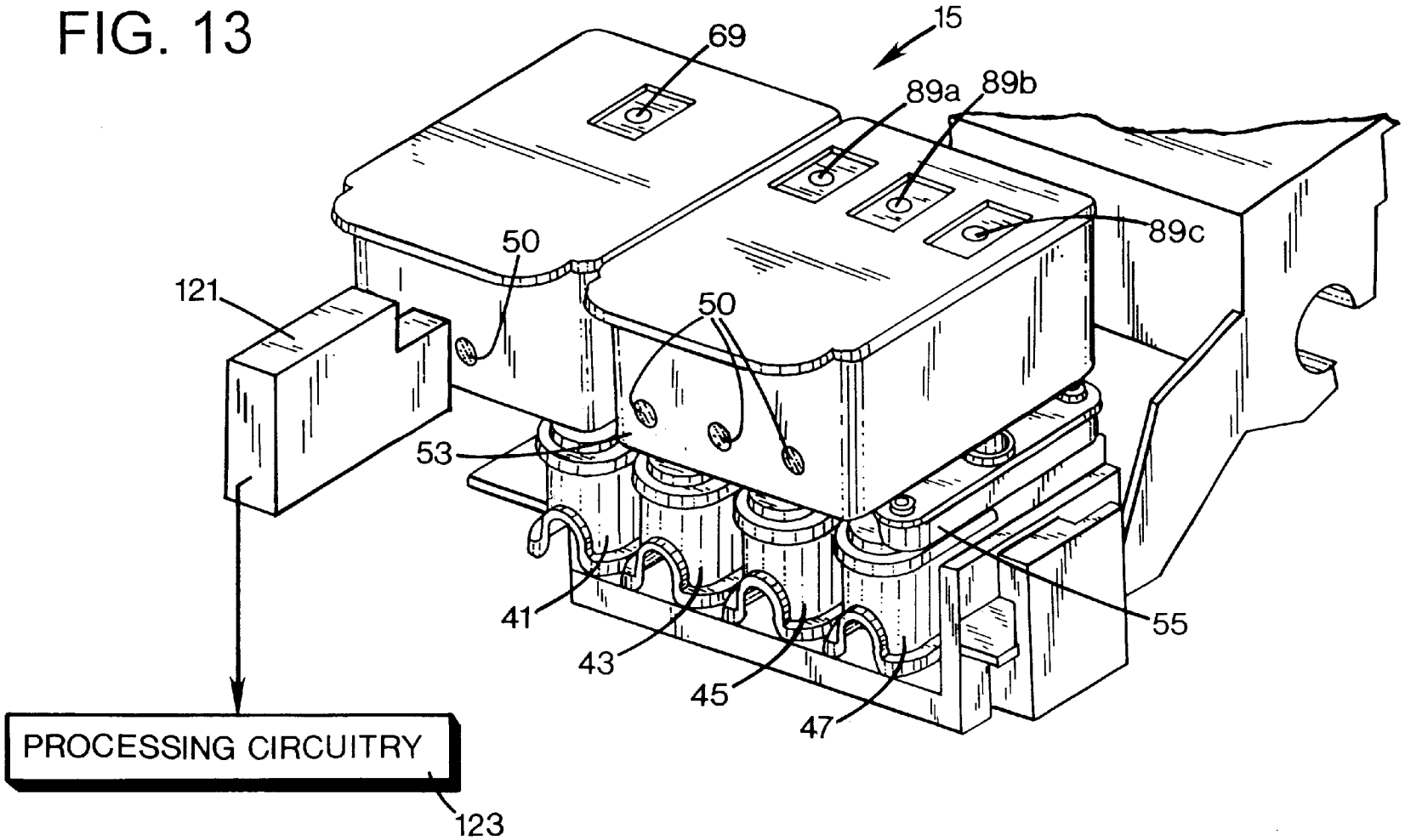
FIG. 13 is a schematic illustration of electro-optical sensing of an ink level indicator of the invention.

Referring now to FIG. 13, ink level indicators 50 in accordance with the invention are electro-optically detectable with an optical detector 121 that is mounted near one end of the travel of the print carriage 15 and elevationally positioned to detect the reflectivity of the ink level indicators 50. By way of illustrative example, the optical detector 121 is comprised of light emitting diodes and a photodetector, and provides an output to suitable processing circuitry 123. In use, the carriage 15 is scanned so that each of the optical indicators 50 is individually positioned within the detection angle of the optical sensor 121.

The foregoing has been a disclosure of an ink level indicating mechanism that is advantageously resistant to being disabled by shock and vibration since ink suspended in a thin capillary element is not readily displaced, and thus is more robust and reliable than ink level indicating mechanisms that are based on free fluid that is not capillarly suspended.

Although the foregoing has been a description and illustration of specific embodiments of the invention, various modifications and changes thereto can be made by persons skilled in the art without departing from the scope and spirit of the invention as defined by the following claims.

What is claimed is:

1. An ink level indicating ink tank for an jet printing system, comprising:

a housing having an interior;

an ink retaining capillary volume in said interior of said housing, said capillary volume having a pressure that is less than ambient pressure;

a thin capillary element in said interior of said housing in contact with said capillary volume;

a fluid impermeable, light transmissive window separated from said thin capillary element for allowing optical detection of said thin capillary element; and said thin capillary element and said fluid impermeable, light transmissive window configured to form a region that is sealed from ambient pressure by said ink retaining capillary volume so long as said ink retaining capillary volume contains sufficient ink to prevent ambient pressure from being communicated to said region, said region having a pressure that is less than said pressure in said ink retaining capillary volume while said region is sealed from ambient pressure by said ink retaining capillary volume.

2. The ink level indicating ink tank of claim 1 wherein:

said housing includes a wall that is configured to be vertical when the ink tank is installed in a printer;

said fluid impermeable, light transmissive window is located in said wall; and said thin capillary element is adjacent and separated from said fluid impermeable, light transmissive window.

3. The ink level indicating ink tank of claim 1 wherein said thin capillary element comprises a filament mesh.

4. The ink level indicating ink tank of claim 1 wherein said thin capillary element comprises a wire filament mesh.

5. The ink level indicating ink tank of claim 1 wherein said housing is configured for removable installation in a print carriage.

6. An ink level indicating inkjet print cartridge, comprising:

a housing having an interior;

an ink retaining capillary volume in said interior of said housing, said capillary volume having a pressure that is less than ambient pressure;

a thin capillary element in said interior of said housing in contact with said capillary volume;

a fluid impermeable, light transmissive window for allowing optical detection of said thin capillary element;

said thin capillary element and said fluid impermeable, light transmissive window configured to form a region that is sealed from ambient pressure by said ink retaining capillary volume so long as said ink retaining capillary volume contains sufficient ink to prevent ambient pressure from being communicated to said region, said region having a pressure that is less than said pressure in said ink retaining capillary volume while said region is sealed from ambient pressure by said ink retaining capillary volume; and a printhead fluidically coupled to said capillary volume.

7. The ink level indicating print cartridge of claim 6 wherein:

said housing includes a wall that is configured to be vertical when the print cartridge is installed in a printer;

said fluid impermeable, light transmissive window is located in said wall; and said thin capillary element is adjacent and separated from said fluid impermeable, light transmissive window.

8. The ink level indicating print cartridge of claim 6 wherein said thin capillary element comprises a filament mesh.

9. The ink level indicating print cartridge of claim 6 wherein said thin capillary element comprises a wire filament mesh.

10. An inkjet printing system for printing on a print medium, comprising:

a print carriage;

a printhead supported by said print carriage;

an ink tank comprised of a housing and fluidically coupled to said printhead;

an ink retaining capillary volume in said interior of said housing, said capillary volume having a pressure that is less than ambient pressure;

a thin capillary element in said interior of said housing in contact with said capillary volume;

a fluid impermeable, light transmissive window for allowing optical detection of said thin capillary element; and said thin capillary element and said fluid impermeable, light transmissive window configured to form a region that is sealed from ambient pressure by said ink retaining capillary volume so long as said ink retaining capillary volume contains sufficient ink to prevent ambient pressure from being communicated to said region, said region having a pressure that is less than said pressure in said ink retaining capillary volume while said region is sealed from ambient pressure by said ink retaining capillary volume.

11. The inkjet printing system of claim 10 wherein:

said housing includes a wall that is configured to be vertical when the ink tank is installed in a printer;

said fluid impermeable, light transmissive window is located in said wall; and said thin capillary element is adjacent and separated from said fluid impermeable, light transmissive window.

12. The inkjet printing system of claim 10 wherein said thin capillary element comprises a filament mesh.

13. The inkjet printing system of claim 10 wherein said thin capillary element comprises a wire filament mesh.

14. The inkjet printing system of claim 10 wherein said ink tank and said printhead form a print cartridge.

* * * * *